US006686866B1

(12) United States Patent
Deckard et al.

(10) Patent No.: US 6,686,866 B1
(45) Date of Patent: Feb. 3, 2004

(54) TWO-PIECE RADAR-ABSORBING END CAP ASSEMBLY

(75) Inventors: Dennis D. Deckard, Bedford, IN (US); David J. Mulinix, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 39 days.

(21) Appl. No.: 10/263,278

(22) Filed: Sep. 26, 2002

(51) Int. Cl.[7] ..... H01Q 17/00

(52) U.S. Cl. ..... 342/2; 342/1; 342/13; 342/14; 342/16

(58) Field of Search ..... 342/1, 2, 13, 14, 342/16; 42/1.15; 102/336

(56) References Cited

U.S. PATENT DOCUMENTS

| | | | | |
|---|---|---|---|---|
| 3,887,920 A | * | 6/1975 | Wright et al. | 342/1 |
| 4,171,669 A | | 10/1979 | Allen | |
| 4,700,190 A | | 10/1987 | Harrington | |
| 5,275,880 A | * | 1/1994 | Boyer et al. | 428/328 |
| 5,525,988 A | * | 6/1996 | Perkins et al. | 342/4 |
| 5,576,710 A | * | 11/1996 | Broderick et al. | 342/1 |
| 5,645,886 A | * | 7/1997 | Schueler et al. | 427/140 |
| 5,717,397 A | * | 2/1998 | Ruszkowski, Jr. | 342/2 |
| 5,855,988 A | * | 1/1999 | Matsuo | 428/195.1 |

OTHER PUBLICATIONS

He Jianguo et al., "Experimental investigation on ultra–wideband radar characteristics of coating RAM's targets", Radar 92. International Conference, Oct. 12–13, 1992, Page(s): 493–496.*

Hsueh–jyh Li et al., "Diaphanization by absorber covering", Antennas and Propagation Society International Symposium, 1988. AP–S. Digest, Jun. 6–10, 1988, Page(s): 790–793 vol. 2.*

Pitman, K.C. at la., "Radar absorbers: better by design", Radar and Signal Processing, IEE Proceedings F, vol.: 138 Issue: 3 , Jun. 1991, Page(s): 223–228.*

* cited by examiner

*Primary Examiner*—Thomas H. Tarcza
*Assistant Examiner*—Isam Alsomiri
(74) *Attorney, Agent, or Firm*—Naval Air Systems Command; Amy I. Ressing

(57) ABSTRACT

The two-piece end cap assembly has an end cap that has a groove around its perimeter and at least one cavity. The end cap is fixed in place inside the flare case with the cavities exposed. Sealant/adhesive is applied to the groove and cavity. A RAM cap, having a flange on its edge corresponding to the size of the flare case and a number of projections corresponding to the cavities, is installed on the top surface of the end cap. The sealant/adhesive in the cavities attaches the RAM cap to the end cap. The sealant/adhesive in the groove is forced to the edges of the end cap and provides a seal between the end cap and the flare case. Radar Absorbing Material is applied to the top and exposed edges of the RAM cap, completely masking the face of the flare and its edges.

4 Claims, 3 Drawing Sheets

TWO-PIECE RADAR-ABSORBING END CAP ASSEMBLY

STATEMENT OF GOVERNMENT INTEREST

The invention described herein may be manufactured and used by or for the Government of the United States of America for governmental purposes without payment of any royalties thereon or therefore.

BACKGROUND OF THE INVENTION

1. Field of the Invention

The present invention relates to flares, more particularly, flares having a radar absorbing end cap.

2. Description of the Related Art

In recent years, the use of stealth technology, including the use of radar absorbing materials, on military aircraft has increased. In order to provide effective radar absorption, the radar-absorbing material must completely cover the exposed areas of a device, as even small gaps in Radar Absorbing Material can be detected by radar.

Flares are used for a variety of applications, including use as decoys. Decoy devices and flares known in the art have a one-piece end cap designed to provide a good seal for the device. Flares that are not sealed can evolve hydrogen gas, making them hazardous to store and handle. Most current decoy flares utilize one-piece end caps with no radar absorbing material. Additionally, the designs of the one-piece end caps do not provide a proper surface for the application of radar absorbing material.

Consequently, there is a need in the art for a flare with effective radar absorbing qualities that is inexpensive to manufacture and is safe to store and handle.

Accordingly, it is an object of the invention to provide a flare with effective radar-absorbing qualities.

It is a further object of the invention to provide a radar absorbing flare that is inexpensive to manufacture and safe to store and handle.

These and other objects and advantages of the invention will appear from the following detailed description, which together with the accompanying drawings discloses a preferred embodiment of the invention for purposes of illustration only.

SUMMARY OF THE INVENTION

A two-piece radar absorbing end cap assembly for a flare is disclosed. The two-piece end cap assembly has an end cap with a top surface, which has a groove around the perimeter of the top surface. Optionally, the top surface of the end cap has at least one cavity. The end cap is installed inside the muzzle end of a flare case with its top surface exposed, preferably by crimping the end cap in place. A sealant/adhesive is applied to the groove and top surface of the end cap. If present, the sealant/adhesive is applied into the at least one cavity of the top surface of the end cap instead of or in addition to being applied to the top surface of the end cap. The second piece of the two-piece assembly, a Radar Absorbing Material (RAM) cap, has a bottom surface, which has a flange surrounding the perimeter of the RAM cap that corresponds in size to the outer dimensions of the flare case. Optionally, the bottom surface of the RAM cap may also have at least one projection, corresponding to the number and location of the optional cavities on the top surface of the end cap.

The RAM cap is installed by adhering the bottom surface of the RAM cap to the top surface of the end cap in the flare case. The sealant/adhesive in the groove of the top surface of the end cap is forced to the edges of the end cap and provides a seal between the end cap and the flare case. The sealant/adhesive on the top surface of the end cap attaches the end cap to the RAM cap. If present, the projections in the bottom surface of the RAM cap are inserted into corresponding cavities on the end cap. The sealant/adhesive in the cavities flows around the projections of the RAM cap, attaching the RAM cap to the end cap.

A coating of Radar Absorbing Material is applied to the top surface of the RAM cap and any exposed edges of the RAM cap, completely masking the full face of the flare and its edges from radar detection.

DETAILED DESCRIPTION OF THE INVENTION

Figure 1:
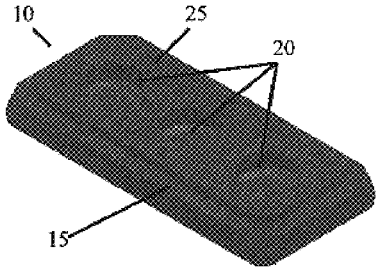
FIG. 1 shows the top surface of the end cap.
Figure 3:
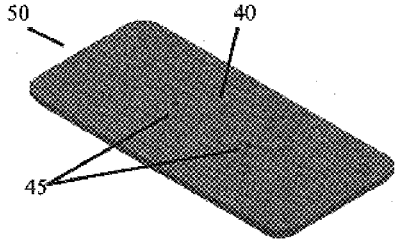
FIG. 3 shows the top surface of the RAM cap.
Figure 2:
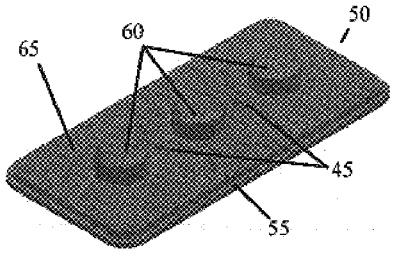
FIG. 2 shows the bottom surface of RAM cap.

The invention relates to a two-piece radar absorbing end cap assembly for a flare case. The two-piece end cap assembly is comprised of an end cap and a RAM cap. FIG. 1 shows the top surface 25 of the end cap 10. A groove 15 is located on the perimeter of the top surface 25 of the end cap 10. The top surface 25 of the end cap 10 contains cavities 20. The end cap 10 has a groove 15 around its perimeter and optionally, at least one cavity 20 on its top surface 25. FIG. 2 shows the bottom surface 65 of RAM cap 50. The RAM cap 50 has two holes 45. The RAM cap 50 has a flange 55 located on the perimeter of the bottom surface 65. The bottom surface has projections 60. FIG. 3 shows the top surface 40 of the RAM cap 50. The RAM cap 50 has two holes 45. The RAM cap 50 has a top surface 40 that provides a flat full-face surface for the attachment of Radar Absorbing Materials or other materials that require a flat full-face surface. The RAM cap 50 has a flange 55 that matches the outside dimensions of the flare case. The RAM cap 50 also optionally may have a number of projections 60, corresponding to the number of cavities 20 on the top surface 25 of the end cap 10, that are sized to fit inside the end cap cavities 20. Preferably, the projections 60 are sized to fit loosely in the cavities 20 of the end cap 10. The size of the cavities 20 and the size of the projection 60 can be varied by design to control differing amounts of sealant/adhesive displaced to the surface of the end cap 10 and the bottom of the RAM cap 50.

Figure 4:
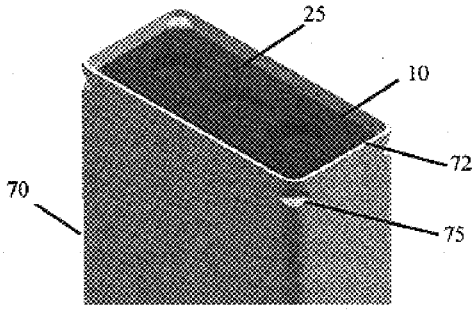
FIG. 4 shows the end cap crimped in place in the flare case having the top surface of the end cap exposed. The end of the flare case is also shown.
Figure 5:
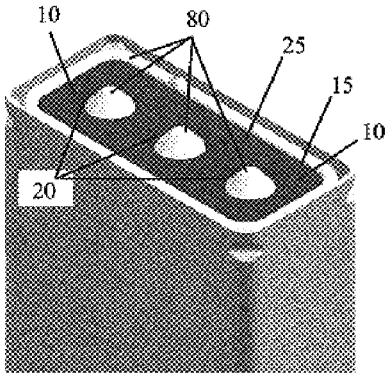
FIG. 5 shows sealant/adhesive applied to the top surface of the end cap.

FIG. 4 shows the end cap 10 crimped 75 in place in the flare case 70 having the top surface 25 of the end cap 10 exposed. The end of the flare case 72 is also shown. The end cap 10 is installed in the muzzle end of the flare case 70, which is the end of the flare case from which the internal payload is ejected. The end cap 10 is fixed into place, typically by crimping, pinning, sealing, adhering, magneforming, or other known ways of fixing an end cap into a flare case. FIG. 5 shows sealant/adhesive 80 applied to the groove 15 and cavities 20 of the top surface 25 of the end cap 10. A sealant/adhesive or epoxy 80 is applied to the groove 15 around the perimeter of the end cap 10 and on to the top surface 25 of the end cap 10. If cavities 20 are present, sealant/adhesive or epoxy 80 is applied into the cavities 20 in the top surface 25 of the end cap 10 in addition to or instead of applying sealant/adhesive 80 to the top surface 25 of the end cap 10. Preferably, the sealant/adhesive 80 is a silicone sealant/adhesive. More preferably, the sealant/adhesive 80 is Room Temperature Vulcanization (RTV) sealant/adhesive.

Figure 6:
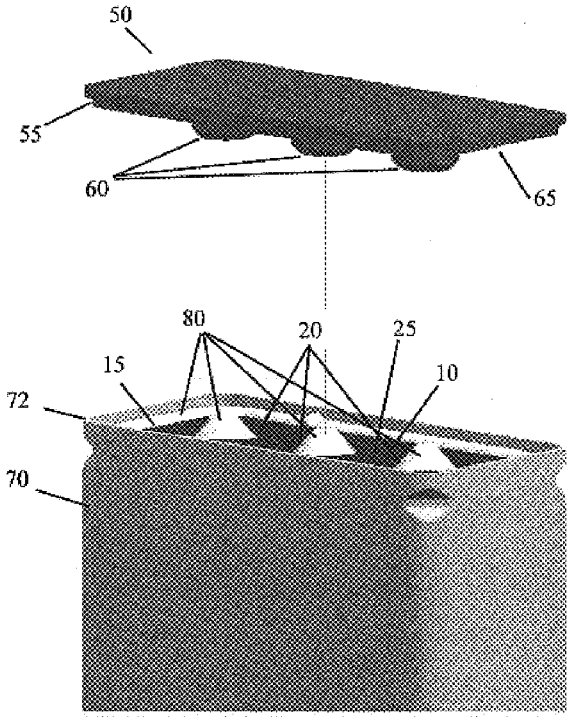
FIG. 6 shows the installation of the RAM cap to the end cap.

FIG. 6 shows the installation of the RAM cap 50 to the end cap 10 whereby the bottom surface 65 of the RAM cap 50 is place on ton of the top surface 25 of the end cap 10, inserting the projections 60 of the RAM cap 50 into the corresponding cavities 20 of the cap 10, whereby the sealant/adhesive 80 flows up and around the projections 60 and attaches the RAM cap 50 to the end cap 10. The sealant/adhesive 80 in the groove 15 of the end cap 10 is pushed to the edges of the end cap 10, creating a seal between the end cap 10 and the flare case 70. The flange 55 of the RAM cap 50 sits on the end of the flare case 72. The RAM cap 50 is installed on top of the end cap 10. If cavities 20 are present, projections 60 are present on the bottom surface 65 of the RAM cap 50, and the projections 60 of the RAM cap 50 are fitted into the sealant/adhesive 80 filled cavities 20 of the end cap 10. The flange 55 of the RAM cap 50 fits over the end of the flare case 72 and matches the outer dimensions of the flare case 70. The cavities 20 provide volumetric control and controlled placement of the sealant/adhesive 80 on the end cap 10. The projections 20 provide additional surface area for attachment of the RAM cap 50 to the end cap 10 via adhesion. The sealant/adhesive 80 in the cavities 20 of the end cap 10 flows up and around the projections 60 of the RAM cap 50. The sealant/adhesive 80 in the perimeter groove 14 of the end cap 10 is forced to the outer edges of the end cap 10 and provides a hermetic seal between the end cap 10 and the flare case 70. The adhesive properties of the sealant 80 hold the end cap 10 and the RAM cap 50 assembly together. At least one optional hole 45 in the top surface of the RAM cap 50 aids in the curing of RTV sealant/adhesive 80. After the sealant/adhesive 80 cures, the Radar Absorbing Material 85 can be applied to the top surface of the RAM Cap 50, completely masking the fill face of the flare and its edges from radar detection.

Figure 7:
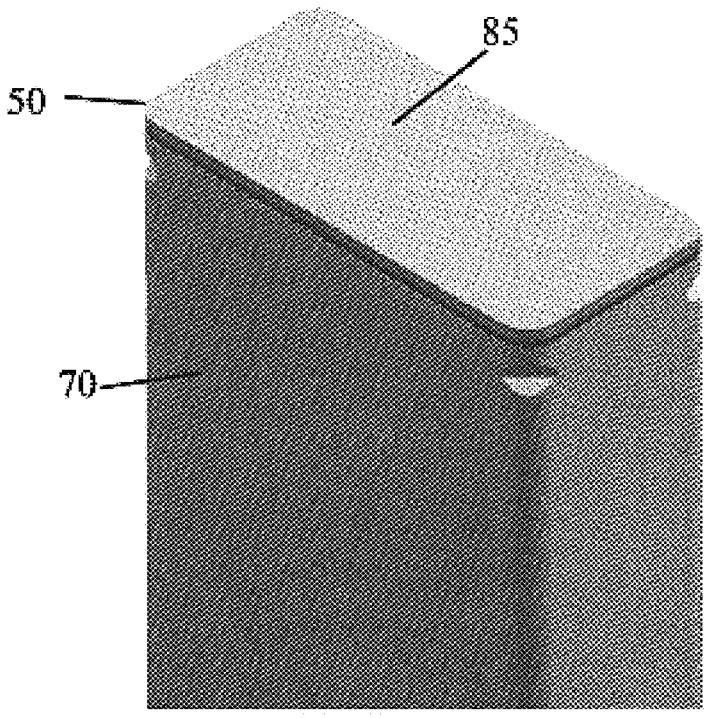
FIG. 7 shows the RAM cap fully installed in the flare case and coated with Radar Absorbing Material.

FIG. 7 shows the RAM cap 50 fully installed in the flare case 70 and coated with Radar Absorbing Material 85. The two-piece radar absorbing end cap assembly provides a flat surface for complete coverage of the exposed face of the decoy device with an application of Radar Absorbing Material 85. The Radar Absorbing Material 85 needs to completely cover the exposed face of the flare because tiny gaps in the coverage of the Radar Absorbing Material can be detected by radar.

The assembly of the two-piece radar absorbing end cap assembly forces the sealant/adhesive approximately equally in all directions to make a good seal between the end cap and the flare case. This makes sealing the flare easier to accomplish, as the seal is not dependent on the assembly operator as is typically the case of assembly of the one-piece end cap designs.

Having described the invention, the following example is given to illustrate specific applications of the invention, including the best mode now known to perform the invention. These specific examples are not intended to limit the scope of the invention described in this application.

EXAMPLES

The two-piece radar absorbing end cap assembly was developed for rectangular flare cases, however the design can clearly be adapted for use with square or round flares. Test devices were produced by making two injection molded plastic pieces, the end cap and the RAM cap. The end cap had a groove around its top perimeter, and had three cavities. These features are for the application of the sealant/adhesive or epoxy. In this example, RTV sealant/adhesive was used. The RAM cap has a flange that matches the outside dimensions of the perimeter of the flare case and three projections that were sized to fit loosely inside the end cap cavities. The RTV sealant/adhesive has a recommended 0.016 to 0.031 inch thickness of sealant/adhesive for best adhesion. The dimensions of the projections and cavities were designed to optimize the adhesive properties of the RTV sealant/adhesive. Other sealant/adhesives or epoxies may have a different recommended thickness; therefore it is understood that the size of the projections and the cavities can be adapted for using other sealant/adhesives or epoxies.

During the assembly of the flare, a payload was first loaded inside the case. The end cap was then installed in the muzzle end of the flare case and crimped in place. RTV sealant/adhesive was applied around the outer groove of the end cap and into the three cavities. The RAM cap was installed on top of the end cap, with the bottom surface of the RAM cap against the top surface of the end cap and the three projections inserted into the corresponding three cavities. The RTV sealant/adhesive in the outer groove of the end cap was forced to the outer edges of the end cap providing an excellent hermetic seal between the end cap and the flare case. The RTV sealant/adhesive in the three cavities flowed up and around the corresponding projections in the RAM cap and into the area between the end cap and the RAM cap. The adhesive qualities of the RTV sealant/adhesive held the two pieces of the end cap assembly together. Two holes in the RAM cap aided in the curing of the RTV sealant/adhesive. After the RTV sealant/adhesive cured, the Radar Absorbing Material was applied to the top surface of the RAM cap, completely masking the full face of the flare and its edges from radar detection.

Obviously, many modifications and variations of the present invention are possible in light of the above teachings. It is therefore to be understood that, within the scope of the appended claims, the invention may be practiced otherwise than as specifically described.

What is claimed is:

1. A two-piece end cap assembly for a flare compromising:

a flare case, having a muzzle end for receiving an end cap assembly, an inner dimension, and an outer dimension;

an end cap having a top surface, the top surface having a perimeter, the perimeter being surrounded by a groove, the end cap being fixed inside the muzzle end of the flare case with said top surface exposed;

a sealant/adhesive applied to the groove and the top surface of the end cap; and a Radar Absorbing Material (RAM) cap, having a top surface and a bottom surface, the top surface having a full flat-face, the bottom surface having a perimeter, the perimeter having a flange surrounding the perimeter that corresponds in size to the outer dimension of the flare case, whereby the bottom surface of the RAM cap is installed on the top surface of the end cap in the flare case, whereby the sealant/adhesive on the top surface of the end cap attaches the RAM cap to the end cap, and whereby the sealant/adhesive in the groove of the top surface of the end cap further provides a seal between the end cap and the flare case.

2. The end cap assembly of claim 1, further comprising:

a coating of Radar Absorbing Material on the top surface of the RAM cap.

3. The end cap assembly of claim 1, wherein the sealant/adhesive is Room Temperture Vulcanization (RTV) sealant/adhesive.

4. The end cap assembly of claim 1, further comprising:

at least one cavity in the top surface of the end cap;

sealant/adhesive applied into the at least one cavity on the top surface of said end cap;

at least one projection on the bottom surface of said RAM cap, corresponding to the at least one cavity on the top surface of the end cap, where the at least one projection of the RAM cap is fitted into the at least one cavity of the end cap, whereby the end cap is attached to the RAM cap by adhesion.

* * * * *